US005378349A

United States Patent [19]

Senn

[11] Patent Number: 5,378,349

[45] Date of Patent: Jan. 3, 1995

[54] PASSIVATED CATALYSTS FOR CRACKING PROCESS

[75] Inventor: Dwayne R. Senn, Bartlesville, Okla.

[73] Assignee: Phillips Petroleum Company, Bartlesville, Okla.

[21] Appl. No.: 67,754

[22] Filed: May 26, 1993

[51] Int. Cl.[6] ..... C10G 11/18

[52] U.S. Cl. ..... 208/121; 208/52 CT; 208/113; 502/521

[58] Field of Search ..... 208/121, 120, 52 CT; 502/521

[56] References Cited

U.S. PATENT DOCUMENTS

| | | | |
|---|---|---|---|
| 3,711,422 | 1/1973 | Johnson | 252/414 |
| 4,290,919 | 9/1981 | McKay et al. | 252/437 |
| 4,424,116 | 1/1984 | Hettinger, Jr. et al. | 208/120 |
| 4,432,890 | 2/1984 | Beck et al. | 502/62 |
| 4,437,981 | 3/1984 | Kovach | 208/295 |
| 4,496,665 | 1/1985 | Hettinger, Jr. et al. | 502/521 |
| 4,770,765 | 9/1988 | Bartek et al. | 208/113 |
| 4,913,801 | 4/1990 | Forester | 208/121 |
| 4,971,935 | 11/1990 | Bartek et al. | 208/121 |
| 5,019,241 | 5/1991 | Forester | 208/120 |
| 5,064,524 | 11/1991 | Forester | 208/121 |

*Primary Examiner*—Helane Myers
*Attorney, Agent, or Firm*—K. K. Brandes

[57] ABSTRACT

A zeolite-containing cracking catalyst is passivated with compounds of (a) antimony and (b) zirconium and/or tungsten. The thus-passivated cracking catalyst is employed in a process for catalytically cracking a hydrocarbon-containing oil feed. In another embodiment, compounds of (a) antimony and (b) zirconium and/or tungsten are added to a hydrocarbon-containing oil feed which is catalytically cracked in the presence of a zeolite-containing cracking catalyst.

34 Claims, No Drawings

PASSIVATED CATALYSTS FOR CRACKING PROCESS

BACKGROUND OF THE INVENTION

In one aspect, this invention relates to the treatment of catalytic cracking catalysts with antimony compound(s) and at least one transition metal compound (so as to alleviate detrimental effects of metal deposits on the catalysts). In another aspect, this invention relates to the use of thus-treated catalysts in a catalytic cracking processes. In a further aspect, this invention relates to a process for catalytically cracking metal-containing oils with a catalyst which has been treated with antimony compound(s) and at least one transition metal compound.

The treatment of metal-contaminated zeolite-containing cracking catalysts with antimony compounds (for enhancing or restoring the activity of these catalyst and/or to increase the gasoline yield and/or to reduce hydrogen generation when these catalysts are employed in catalytic oil cracking processes) is well known under the term of "metals passivation" and has been described in the patent literature (e.g., in U.S. Pat. Nos. 3,711,422 and 4,025,458). Also described in the patent literature (e.g., in U.S. Pat. No. 4,183,803) are processes for catalytically cracking heavy oils to which an antimony compound has been added as a passivating agent. In the present invention, the passivating effect of antimony compounds is enhanced by the use of at least one additional compound of a transition metal.

SUMMARY OF THE INVENTION

It is an object of this invention to provide a method of treating metal-contaminated, zeolite-containing cracking catalysts with at least one antimony compound and at least one other metal compound so as to improve the catalytic cracking performance of these catalysts. It is another object of this invention to provide catalytic cracking processes which employs the above-treated (passivated) cracking catalysts. It is a further object of this invention to carry out catalytic cracking processes with metal-contaminated oil feeds to which at least one antimony compound and at least one other metal compound have been added. The use of antimony compound(s) and of the other metal compound(s) in the present invention results in benefits attained during catalytic cracking, in particular higher oil feed conversion and/or higher gasoline yield, and generally also higher oil feed conversion and/or higher isobutane yield and/or lower yield of undesirable heavy cycle oil and/or lower hydrogen generation. Other objects and advantages will become apparent from the detailed description of the invention and the appended claims.

In accordance with this invention, a zeolite-containing catalytic cracking catalyst which contains at least one metal contaminant (particularly nickel compounds) is contacted with at least one antimony compound and at least one compound of at least one transition metal selected from the group consisting of zirconium and tungsten so as to provide a passivated catalyst, wherein at least about 0.01 weight percent antimony and at least about 0.01 weight percent of said at least one transition metal have been incorporated into said catalytic cracking catalyst.

Also in accordance with this invention, there is provided a passivated zeolite-containing catalytic cracking catalyst into which at least about 0.01 weight percent antimony and at least about 0.01 weight percent of said at least one transition metal have been incorporated (by the passivation method described above).

Further in accordance with this invention, there is provided a process for catalytically cracking a hydrocarbon-containing oil feed, substantially in the absence of added hydrogen gas, in the presence of a passivated zeolite-containing catalytic cracking catalyst into which at least about 0.01 weight percent antimony and at least about 0.01 weight percent of said at least one transition metal have been incorporated (by the passivation method described above).

Still further in accordance with this invention, a process for catalytically cracking a hydrocarbon-containing oil feed, substantially in the absence of added hydrogen gas, in the presence of a zeolite-containing catalytic cracking catalyst, wherein an effective amount of at least one antimony compound and an effective amount of at least one compound of at least one transition metal selected from the group consisting of zirconium and tungsten have been added to said oil feed so as to attain a higher gasoline yield (and generally also higher feed conversion and/or lower hydrogen generation and/or lower coke generation and/or higher isobutane yield).

DETAILED DESCRIPTION OF THE INVENTION

Any zeolite-containing catalytic cracking catalyst can be used in the processes of this invention. The catalytic cracking catalyst can be a fresh (i.e., unused) material or a "spent" material (i.e., having been used in a previous process for catalytically cracking a hydrocarbon-containing oil which generally contains Ni, V and possibly other metal impurities, and having been regenerated by stream-stripping and coke burn-off) or an "equilibrium catalyst" material (i.e., a mixture of "spent" and fresh catalyst material, generally containing about 90–95 weight-% of "spent" catalyst). The zeolite component of the cracking catalyst composition can be any natural or synthetic crystalline aluminosilicate zeolite which exhibits cracking activity. Non-limiting examples of such zeolites are faujasite, chabazite, mordenite, offretite, erionite, Zeolon, zeolite X, zeolite Y, zeolite L, zeolite ZSM-4, zeolite ZSM-5, zeolite ZSM-11, zeolite ZSM-12, zeolite ZSM-23, zeolite ZSM-35, zeolite ZSM-38, zeolite ZSM-48, and the like, and mixtures thereof. Additional examples of suitable zeolites are listed in U.S. Pat. No. 4,158,621. The term "zeolite", as used herein, includes zeolites which have been pretreated, such as those from which a portion of Al has been removed from the crystalline framework, and zeolites which have been ion-exchanged with rare earth metal or ammonium or by other conventional ion-exchange methods. The term "zeolite", as used herein, also includes essentially aluminum-free silica polymorphs, such as silicalite, chromia-silicates, ferrosilicates, borosilicates, and the like, as disclosed in U.S. Pat. No. 4,556,749.

Generally, the zeolite component of the catalytic cracking catalyst composition is embedded in a suitable solid refractory inorganic matrix material, such as alumina, silica, silica-alumina (presently preferred), clay, aluminum phosphate, magnesium oxide, mixtures of two or more of the above-listed materials, and the like. The preparation of such zeolite/matrix cracking catalyst compositions is well known and is not a critical feature of this invention. Generally, the surface area (measured by nitrogen adsorption, substantially in accordance with the BET method of Brunauer, Emmett and Teller) of the zeolite/matrix cracking catalyst composition is in the range of from about 50 to about 800 $m^2/g$. Generally, the weight ratio of zeolite to matrix material in the catalytic cracking catalyst composition is in the range of from about 1:20 to about 1:1. The catalytic cracking catalyst composition comprising zeolite and matrix material can have any suitable particle size, and generally is coarser than about 200 mesh. The catalyst composition can be an extrudate or a pelletized material or an irregularly shaped material (depending on the particular type of cracking operation in which it is to be used).

The contacting of the zeolite-containing catalytic cracking catalyst with antimony compound(s) and zirconium and/or tungsten compounds in accordance with the first embodiment of this invention can be carried out in any suitable manner. In one mode of operation, the cracking catalyst is contacted in any suitable manner (preferably by impregnation or by spraying) with a solution (or, alternatively, colloidal dispersion) which contains antimony compound(s) and the at least one transition metal compound (i.e., zirconium and/or tungsten compounds). These compounds are generally dissolved in a suitable solvent (which may be a normally liquid hydrocarbon or water or any other liquid which dissolves a sufficient amount of these compounds). It is within the scope of this invention to employ treating agents in which the antimony and transition metal compounds are colloidally dispersed in a liquid.

In another mode of operation, a first solution (or, alternatively, colloidal dispersion) containing Sb compound(s) and a second solution (or, alternatively, colloidal dispersion) containing Zr and/or W compound(s) are prepared, and the catalyst composition is then contacted with the first solution (or colloidal dispersion) and thereafter with the second solution (or colloidal dispersion), either by impregnation or by spraying or by any other suitable contacting means. Or the catalyst composition is contacted with the second solution (or colloidal dispersion) and thereafter with the first solution (or colloidal dispersion), either by impregnation or by spraying or by any other suitable means. Or the catalyst composition is substantially simultaneously contacted (preferably sprayed) with the first solution (or colloidal dispersion) and the second solution (or colloidal dispersion).

Any suitable concentration of antimony and zirconium and/or tungsten in the treating agents (i.e., either solutions or colloidal dispersions of the above-described compounds) can be employed. Generally, treating agents (herein also referred to as passivating agents contain about 0.01–0.5 mol/l Sb and about 0.01–0.5 mol/l Zr or, alternatively, about 0.01–0.5 mole/l W or, alternatively, about 0.01–0.5 mol/l (Zr+W). Any suitable weight ratio of at least one dissolved (or colloidally dispersed) antimony compound to the catalyst composition can be applied. Generally, the weight ratio of antimony compound(s) to the cracking catalyst is such as to provide a level of about 0.01–0.5 weight-% (preferably about 0.05–1 weight-%) antimony in the passivated catalyst. Also, any suitable weight ratio of at least one transition metal compound (i.e., at least one compound of zirconium or tungsten or both) to the cracking catalyst composition can be applied. Generally, the weight ratio of transition metal compounds to the cracking catalyst is such as to provide a level of about 0.01–5 weight-% (preferably about 0.02–1 weight-%) of the at least one transition metal in the passivated catalyst. It is understood that the cracking catalyst to be passivated may already contain some Sb and Zr and/or W (because it is a "spent" catalyst or an "equilibrium" catalyst which has undergone a previous passivation). In this case, the incorporation of smaller amounts of Sb and of Zr and/or W in the present passivation process is required to attain the above-recited levels of Sb and of Zr and/or W in the passivated catalyst.

Any suitable antimony compound can be employed as the first treating agent. Non-limiting examples of suitable Sb compounds are described in various patents (e.g., U.S. Pat. Nos. 3,711,422, 4,025,458, 4,190,552, 4,193,891, 4,263,131, among others). Preferred antimony compounds are antimony hydroxyhydrocarbylthiolates, such as antimony tris(2-hydroxyethylthiolate), antimony tris(O,O-dihydrocarbyl)phosphorodithiolates, antimony oxides (more preferably $Sb_2O_5$), antimony carboxylates, antimony mercaptides, antimony fluoride and mixtures thereof. Presently preferred is antimony tris(2-hydroxyethylthiolate) dissolved in a organic solvent (more preferably 2-hydroxyethyl mercaptan, also referred to as 2-hydroxyethanethiol).

Any suitable zirconium compound can be employed as the second treating agent. Non-limiting examples of suitable Zr compounds are those described in U.S. Pat. No. 4,424,116 (column 24) and include zirconium tetraisopropoxide and other zirconium alcoholates, zirconium (IV) acetylacetonate (also referred to as zirconium tetra-2,4-pentanedionate), $Zr(C_5H_7O_2)_4$, zirconium(IV) nitrate, zirconium(IV) sulfate or oxysulfate, zirconium(IV) acetate and other zirconium(IV) carboxylates, zirconium phenolates, zirconium naphthenates, and mixtures thereof. Zirconium(IV) acetylacetonate is the presently preferred Zr additive. These zirconium compounds are generally applied as solutions wherein the solvents are frequently polar organic solvents or liquid hydrocarbons.

Any suitable tungsten compound can be employed as the alternative second treating agent. Non-limiting examples of suitable W compounds are described in U.S. Pat. No. 4,290,919 and include alkali metal tungstates (such as $Na_2WO_4$), the corresponding ammonium tungstate (presently preferred), alkali metal or ammonium salts of hexatungstic acid ($H_{12}W_6O_{24}$) or dodecatungstic acid $H_8W_{12}O_{40}$), alkali metal or ammonium tetrathiotungstates, alkali metal or ammonium salts of heteropolyacids of tungsten (such as $H_3PW_{12}O_{40}$ and the like), tungsten hexa(di-n-propyl-phosphorodithioate), tungsten halides or oxyhalides (such as $WF_6$, $WCl_6$, $WCl_4$, $WOCl_4$ and the like), and mixtures of two or more than two of these compounds. Generally, these compounds are dissolved in a suitable solvent (such as water or in an organic solvent).

The thus-treated (passivated) catalytic cracking catalyst composition (now containing Sb and either Zr or W or Zr+W) is generally dried, preferably at about 80°–120° C. for about 0.5–10 hours, and frequently also calcined, preferably at about 500°–800° C. for about 0.5–8 hours (in air or in an inert gas atmosphere, with or without added steam). If the contacting of the catalytic cracking catalyst composition with the liquid passivating solution (or, alternatively, colloidal dispersion) is carried out with a hot catalyst composition (generally having a temperature of about 400°–700° C., e.g., one which is present in or exits from the oxidative regenerator of a catalytic cracking unit), separate heating (i.e., drying, calcining) steps can be omitted, because the drying occurs immediately after the contacting of the passivating agent(s) and the hot catalyst. Thus, it is within the scope of this invention to have contacting and drying steps occur substantially simultaneously.

The catalytic cracking catalyst composition which has been contacted (passivated) with antimony and the at least one transition metal compound in accordance with this invention can be used in any catalytic cracking process, i.e., a process for catalytically cracking hydrocarbon-containing oil feedstocks, in any suitable cracking reactor (e.g., in a FCC reactor or in a Thermofor moving bed reactor). The term "catalytic cracking", as used herein, implies that essentially no hydrocracking occurs and that the catalytic cracking process is carried out with a hydrocarbon-containing oil feed substantially in the absence of added hydrogen gas, under such conditions as to obtain at least one liquid product stream having a higher API gravity (measured at 60° F.) than the feed. The treated catalyst composition can be used alone or in admixture with fresh (unused) zeolite-containing catalyst composition in catalytic cracking processes.

The hydrocarbon-containing feed stream for the catalytic cracking process of this invention can be any suitable feedstock. Generally, the feed has an initial boiling point (ASTM D1160) exceeding about 400° F., and preferably has a boiling range of from about 400° to about 1200° F., more preferably a boiling range of about 500° to about 1100° F., measured at atmospheric pressure conditions. Generally, this feed contains metal impurities, particularly nickel and vanadium compounds (generally in excess of about 0.01 ppm Ni and about 0.01 ppm V). The API gravity (measured at 60° F.) generally is in the range of from about 5 to about 40, preferably from about 10 to about 35. Generally, these feedstocks contain Ramsbottom carbon residue (ASTM D524; usually about 0.1–20 weight-%), sulfur (generally about 0.1–5 weight-% S), nitrogen (generally about 0.05–2 weight-% N), nickel (generally about 0.05–30 ppm Ni, i.e., about 0.05–30 parts by weight of Ni per million parts by weight of oil feed) and vanadium (generally about 0.1–50 ppm V, i.e., about 0.1–50 parts by weight of vanadium per million parts by weight of oil feed). Small amounts (generally about 0.01–50 ppm) of other metal impurities, such as compounds of Cu, Na, and Fe may also be present in the oil feed. Non-limiting examples of suitable feedstocks are light gas oils, heavy gas oils, vacuum gas oils, cracker recycle oils (light cycle oils and heavy oils), residua (such as distillation bottoms fractions), and hydrotreated residua (e.g., hydrotreated in the presence of Ni, Co, Mo-promoted alumina catalysts), liquid coal pyrolyzates, liquid products from the extraction or pyrolysis of tar sand, shale oils, heavy fractions of shale oils, and the like. The presently most preferred feedstocks are heavy gas oils and hydrotreated residua.

Any suitable reactor can be used for the catalytic cracking process of this invention. Generally, a fluidized-bed catalytic cracking (FCC) reactor (preferably containing one or more risers) or a moving-bed catalytic cracking reactor (e.g., a Thermofor catalytic cracker) is employed. Preferably, the reactor is a FCC riser cracking unit. Examples of such FCC cracking units are described in U.S. Pat. Nos. 4,377,470 and 4,424,116. Generally a catalyst regeneration unit (for removal of coke deposits) is combined with the FCC cracking unit, as is shown in the above-cited patents.

Specific operating conditions of the cracking operation greatly depend on the type of feedstock, the type and dimensions of the cracking reactor and the oil feed rate. Examples of operating conditions are described in the above-cited patents and in any other publications. In an FCC operation, generally the weight ratio of catalyst composition to oil feed (i.e., hydrocarbon-containing feed) ranges from about 2:1 to about 10:1, the contact time between oil feed and catalyst is in the range of from about 0.2 to about 2.0 seconds, and the cracking temperature is in the range of from about 800° to about 1200° F. Generally, steam is added with the oil feed to the FCC reactor so as to aid in the dispersion of the oil as droplets. Generally, the weight ratio of steam to oil feed is in the range of from about 0.05:1 to about 0.5:1.

The separation of the thus employed cracking catalyst composition from gaseous and liquid cracked products (in particular hydrocarbons) and the separation of cracked products into various gaseous and liquid product fractions can be carried out by any well known, conventional separation means. The most desirable product fraction is gasoline (ASTM boiling range: about 80°–400° F.). Non-limiting examples of such separation schemes are showing in "Petroleum Refining" by James H. Gary and Glenn E. Handwerk, Marcel Dekker, Inc., 1975.

Generally, the used cracking catalyst composition which has been separated from cracked gaseous and liquid products (e.g., in a cyclone) is then regenerated, preferably by steam-stripping for removal of adhered oil and by subsequent heating under oxidizing conditions so as to burn off carbon deposits by conventional means. At least a portion of the regenerated cracking catalyst composition can then be treated by the catalyst treating process of this invention, described above. Thereafter, the regenerated and passivated catalyst is recycled to the catalytic cracking reactor, generally in admixture with fresh (unused) cracking catalyst.

In one preferred embodiment of this invention, the passivating agents (prepared from at least one antimony compound and the at least one transition metal compound) are added to the hydrocarbon-containing oil feed stream before it enters the catalytic cracking reactor. The passivating agents are either injected directly into the oil feed or into a slurry oil recycle stream (the highest boiling fraction of cracked products, generally containing dispersed catalyst fines) which is then combined with fresh oil feed. The cracking catalyst comes in contact with the oil feed in the cracking zone where Sb and Zr and/or W are absorbed by and incorporated into the catalyst, thus providing a passivated catalyst in the cracking zone. The employed antimony and transition metal concentrations of the passivating solutions (or, alternatively, colloidal dispersion) and their injection rates are dependent on the metal contaminant content of the feed, but are generally chosen such that at least about 0.01 weight-% Sb and at least about 0.01 weight-% of said at least one transition metal are incorporated into the catalyst in the cracking zone. Generally, the passivated cracking catalyst, when it is present in the cracking zone after it has been brought into contact with the passivating agent(s), contains about 0.01 to about 5 weight-% (preferably about 0.02–1 weight-%) Sb and about 0.01 to about 5 weight-% (preferably about 0.02–1 weight-%) Zr or W or (Zr+W). Generally, the concentration of added antimony (on an elemental basis) in the oil feed is about 0.1–5,000 ppm Sb and the concentrations of added zirconium and/or tungsten (on an elemental basis) in the oil feed is about 0.1–5,000 ppm Zr or 0.1–5,000 ppm W or 0.1–5,000 ppm (Zr+W). In another (presently less preferred) embodiment, the passivating agent(s) can be injected directly into the catalytic cracking reactor, at such an amount and rate as to provide the above-recited levels of Sb and of Zr and/or W in the catalyst. It is, of course, within the scope of this invention to add Sb and Zr and/or W compounds to the oil feed and also employ a zeolite-containing cracking catalyst which already contains some Sb and Zr and/or W (because the catalyst is a "spent" or "equilibrium" catalyst which has previously undergone passivation). In this latter case, the amounts of Sb and Zr and/or W compounds which are injected into the feed are adjusted such that the above-recited levels of Sb and of Zr and/or W in the passivated catalyst in the cracking zone are attained.

In a further preferred embodiment, at least one passivating solution (or colloidal dispersion) described above is injected into the oxidative regenerator (described above) so that the liquid treating agent(s) come in contact with the hot spent catalyst which results in the deposition of compounds of Sb and of Zr and/or W contained in the solution (or colloidal dispersion) on the catalyst and in substantial simultaneous drying/calcining of the passivated catalyst. The at least one passivating solution (or colloidal dispersion) is injected into the regenerator at such a rate as to provide the above-specified levels of Sb and of Zr and/or W in the regenerated cracking catalyst composition. It is also within the scope of this invention to inject the liquid treating agent(s) into conduits transporting hot "spent" catalyst to or from the regenerator. The thus-treated regenerated catalytic cracking catalyst composition can then be recycled, optionally admixed with fresh (treated or untreated) cracking catalyst composition, to the catalytic cracking zone.

The following examples are presented to further illustrate this invention and are not to be considered as unduly limiting the scope of this invention.

EXAMPLE I

This example illustrates the treatment of a nickel-containing catalytic cracking catalyst with antimony and zirconium compound(s) and the use of the thus-treated catalysts for catalytic cracking.

Catalyst A (Control) was prepared as follows. A fresh, commercially available zeolite-containing cracking catalyst (containing about 36 weight-% zeolite having a unit cell size of 24.31 angstroms and about 64 weight percent silica-alumina binder material; having a total surface are of about 346 $m^2/g$; supplied by Engelhard Chemical Company, Edison, N.J. under the product designation of 1160D) was impregnated at about 20° C. with a solution of nickel 2-ethylhexanoate in toluene (containing about 12.7 weight-% Ni; provided by Mooney Chemicals, Cleveland, Ohio), such as to incorporate about 2,400 ppm Ni into the catalyst, dried at about 230° C., cooled to room temperature and calcined in air for 2 hours at 1300° F. The thus-treated catalyst simulates a used cracking catalyst having been contaminated with nickel.

Catalyst B (Control) was prepared by impregnating 50 g of Catalyst A (containing 2400 ppm Ni) with a mixture of 0.286 g Phil-Ad CA 3000 (a solution of antimony tris(2,hydroxyethylthiolate) in 2-hydroxyethanethiol containing about 21 weight-% Sb) and 30 mL acetone. The thus-impregnated catalyst was dried, calcined for 1 hour in air at 1250° F., and treated for 4 hours with 100% steam at 1425° F. Thereafter, additional Sb was added by impregnating 49.1 g of the above-described treated catalyst (containing about 1200 ppm Sb) with a solution of 0.842 g Phil-Ad CA 3000, and the thus-impregnated catalyst was heated in ten sequential oxidation/reduction cycles, wherein each oxidation/reduction cycle was carried out as follows: heating the catalyst to 1300° C. in a nitrogen gas atmosphere over a period of 1.1 minute, maintaining this temperature for 3 minutes while passing nitrogen gas over the catalyst, heating the catalyst in an air stream at 1300° F. for 16 minutes, purging the catalyst with nitrogen gas at 1300° F. for 4 minutes, and cooling the catalyst to 900° F. over a period of about 4 minutes in a stream of a hydrogen/nitrogen gas mixture (having a $H_2$:$N_2$ volume ratio of 2:1). Catalyst B contained about 4800 ppm Sb.

Catalyst C (Control) was prepared by impregnating 50 g of Catalyst A (containing 2400 ppm Ni) with a mixture of a 0.241 g of a Zr(IV) acetylacetonate solution (containing 18.7 weight-% Zr; available from Alpha Chemical Co., Ward Hill, Mass.), 15 mL acetone and 15 mL methanol. The catalyst was then dried, calcined and steam-treated, as described for Catalyst B. Additional Zr was incorporated into the catalyst by impregnating 25.1 g of the above-described treated catalyst (containing 900 ppm Zr) with 0.362 g Zr(IV) acetylacetonate, followed by heating in ten oxidation/reduction cycles (as described for Catalyst B). Catalyst C contained about 3600 ppm Zr.

Catalyst D (Invention) was prepared by impregnating 50.0 g of Catalyst A (containing 2400 ppm Ni) with a mixture of 0.286 g Phil-Ad CA 3000 and 30 mL acetone and thereafter with a mixture of 0.241 g of the above described Zr(IV) acetylacetonate solution, 15 mL acetone and 15 mL methanol. The thus-impregnated catalyst was dried, calcined in air for 1 hour at 1250° F., and treated for 4 hours with 100% stream at 1425° F. Additional Sb and Zr was added by impregnating 49.2 g of the above-treated catalyst (containing 1200 ppm Sb and 900 ppm Zr) with 0.709 g of the above-described Zr(IV) acetylacetonate solution and with 0.842 g of Phil-Ad CA 3000, followed by heating in 14 oxidation/reduction cycles (as described for Catalyst B). Catalyst D contained 4800 ppm Sb and 3600 ppm Zr.

Catalysts A–D were then evaluated in a laboratory MAT cracking test apparatus, substantially as described in ASTM Method D3907, employing a hydrotreated crude oil feed containing 5.3 weight-% Conradson carbon, 0.6 weight-% sulfur, 0.2 weight-% nitrogen, 0.7 weight-% n-pentane insolubles, 5.3 ppm Ni and 7.2 ppm V. The MAT tests were carried out at a catalyst:oil weight ratio of about 3:1, a reaction temperature of 950° F., a reaction time of 75 seconds, a steam-stripping cycle of 10 minutes, and a regeneration cycle of 30 minutes at a temperature of 1250° F. Pertinent test results (averages of two measurements) are summarized in Table I.

TABLE I

| Catalyst | Catalyst Additive | % Feed Conversion | % Gasoline Yield | % Light Cycle Oil Yield | % Heavy Cycle Oil Yield | % Coke Yield | $H_2$ Yield (SCF/BF)[1] | % $C_1$—$C_4$ Yield[2] |
|---|---|---|---|---|---|---|---|---|
| A | — | 77.4 | 48.1 | 15.7 | 6.8 | 13.3 | 412 | 16.0 |
| B | 4800 ppm Sb | 78.8 | 51.4 | 14.4 | 6.8 | 11.5 | 238 | 16.0 |
| C | 3600 ppm Zr | 78.2 | 47.7 | 14.9 | 6.9 | 14.0 | 456 | 16.6 |
| D | 4800 ppm Sb + 3600 ppm Zr | 79.0 | 52.3 | 14.7 | 6.4 | 11.3 | 216 | 15.6 |

[1]Standard cubic feet $H_2$ per barrel feed oil

[2]Yields of individual $C_1$—$C_4$ hydrocarbons were: 1.3–1.4% methane, about 0.9% ethylene, 0.9–1.1% ethane, 4.1–4.4% propylene, 3.0–3.7% n-butenes, 3.1–3.6% isobutane, and 0.8–1.0% n-butane Note:

All % yields were calculated as follows: weight of individual product (per hour) divided by weight of converted feed (per hour) times 100.

Test data in Table I show that the cracking test employing Catalyst D (containing both Sb and Zr) gave the highest feed conversion, the highest gasoline yield, the lowest yields of undesirable heavy cycle oil, of coke, of hydrogen gas and of light hydrocarbon gases. These test results are surprising in view of the fact that treatment with Zr alone actually lowered the gasoline yield (versus base Catalyst A) and caused an increase of heavy oil yield, coke yield, $H_2$ gas yield and $C_1$–$C_4$ gas yield. In addition to the test data shown in Table I, it was also observed that in the $C_1$–$C_4$ hydrocarbon product obtained with Catalyst D, the ratio of desirable isobutane to less desirable n-butanes and n-butenes was greater in the run with Catalyst D than in the other three cracking test runs.

heated in 38 oxidation/reduction cycles (as described for Catalyst B). Catalyst G contained about 600 ppm Zr.

Catalyst H (Invention) was prepared by impregnating 50.0 g of Catalyst E with a mixture of 0.191 g of Phil-Ad CA 3000 and 30 mL of acetone, drying the Sb-impregnated catalyst, and impregnating it with 0.160 g of a mixture of the Zr(IV) acetylacetonate solution (described in Example I) and 30 mL of methanol. The twice-impregnated catalyst was dried, calcined for 1 hour in air at 1250° F., and heated in 14 oxidation/reduction cycles (as described for Catalyst B). Catalyst H contained about 800 ppm Sb and about 600 ppm Zr.

Catalysts E–H were evaluated in a MAT cracking test apparatus, according to the procedure described in Example I. Pertinent test results (averages of two measurements) are summarized in Table II.

TABLE II

| Catalyst | Catalyst Additive | % Feed Conversion | % Gasoline Yield | % Light Cycle Oil Yield | % Heavy Cycle Oil Yield | % Coke Yield | $H_2$ Yield (SCF/BF)[1] | % $C_1$–$C_4$ Yield[2] |
|---|---|---|---|---|---|---|---|---|
| E | — | 73.2 | 46.9 | 17.8 | 9.0 | 11.7 | 421 | 14.6 |
| F | 800 ppm Sb | 73.6 | 48.0 | 17.3 | 9.2 | 10.9 | 371 | 14.6 |
| G | 600 ppm Zr | 72.6 | 46.9 | 17.3 | 10.1 | 10.9 | 397 | 14.8 |
| H | 800 ppm Sb + 600 ppm Zr | 73.2 | 48.0 | 17.8 | 8.9 | 11.0 | 343 | 14.2 |

[1]Standard cubic feet $H_2$ per barrel feed oil

[2]Yields of individual $C_1$–$C_4$ hydrocarbons were: 1.4–1.6% methane, about 0.8% ethylene, about 1.1% ethane, 3.8–4.0% propylene, 3.7–3.8% n-butenes, about 2.1% isobutane, and 0.6–0.7% n-butane Note:

All % yields were calculated as follows: weight of individual product (per hour) divided by weight of converted feed (per hour) times 100.

EXAMPLE II

This examples illustrates the treatment of a nickel/vanadium-contaminated FCC equilibrium cracking catalyst with antimony and zirconium compound(s), and the use of the thus-treated catalyst for catalytic cracking.

Catalyst E (Control) was a regenerated equilibrium cracking catalyst obtained from a FCC unit of a refinery of Phillips Petroleum Company. This catalyst contained about 44 weight-% zeolite having a unit cell size of 24.29 angstrom and about 56 weight-% silica-alumina binder (matrix) material, had a total surface area of 171 $m^2/g$, and contained about 800 ppm Ni and about 900 ppm V as impurities (from previous use in a commercial catalytic cracking operation).

Catalyst F (Control) was prepared by impregnating 50.0 g of Catalyst E with a mixture of 0.191 g of Phil-Ad CA 3000 (described in Example I) and 30 mL acetone. The thus-treated catalyst was dried and heated in 12 oxidation/reduction cycles (as described for Catalyst B). Catalyst F contained about 800 ppm Sb.

Catalyst G (Control) was prepared by impregnating 50.0 g of Catalyst E with a mixture of 0.160 g of a zirconium(IV) acetylacetonate solution (described in Example I) and 30 mL methanol. The thus-treated catalyst was dried, calcined for 1 hour in air at 1250° F., and Test data in Table II indicate that the run employing invention Catalyst H resulted in low yields of heavy cycle oil, of $C_1$–$C_4$ hydrocarbons and of hydrogen gas, and in a high gasoline yield. The somewhat smaller effects (as compared with effects demonstrated in Table I) attained by passivation with Sb+Zr (versus Sb alone and Zr alone) are probably due to the fact that base Catalyst E (this example) contained Ni and V impurities whereas base Catalyst A (Example I) contained only Ni impurities. It is believed that the beneficial effects of passivation with Sb and Zr compounds are most pronounced when the metal impurities in the cracking catalyst consist predominantly of nickel compounds.

EXAMPLE III

This example illustrates the treatment of a nickel-containing catalytic cracking catalyst with antimony and tungsten compound(s), and the use of the thus-treated catalysts for catalytic cracking.

Catalyst I (Control) was prepared as follows. A fresh commercially available zeolite-containing cracking catalyst (containing about 23 weight-% of a zeolite having a unit cell size of 24.50 angstroms and about 77 weight-% silica-alumina binder material; having a total surface area of 189 $m^2/g$; supplied by the Davison Catalyst Company of W. R. Grace and Co., Baltimore, Md., under the product designation of GXP-5) was impregnated with a nickel compound, followed by drying and calcining as has been described for Catalyst A. Catalyst I contained about 2400 ppm Ni.

Catalyst J (Control) was prepared by impregnating Catalyst I with Phil-Ad CA 3000, followed by drying and calcining, as has been described for Catalyst B. The obtained catalyst material, which contained about 1000 ppm Sb, was impregnated again with 0.292 g Phil-Ad CA 3000 and 15 mL acetone followed by drying, calcined at 1250° F. in air, and heated in 10 oxidation/reduction cycles (as described for Catalyst B). Catalyst J contained about 4800 ppm Sb.

Catalyst K (Control) was prepared by impregnating 100 g of Catalyst I with a solution of 0.21 g ammonium tungstate in water, followed by heating (on a hot plate) to dryness, calcining at 1250° F. in air, and heating for 4 hours with 100% steam at 1425° F. Catalyst K contained about 1500 ppm W.

Catalyst L (Invention) was prepared by impregnating 100 g of Catalyst I with 0.11 g of ammonium tungstate dissolved in water and 0.24 g of Phil-Ad CA 3000, followed by heating on a hot plate to dryness, calcining in air, and treatment for 4 hours with 100% steam at 1425° F. 20 g of the thus-obtained catalyst, which contained about 500 ppm Sb and about 750 ppm W, was then impregnated with a mixture of 0.410 g Phil-Ad CA 3000 and 15 mL acetone, dried, and impregnated with a solution of 0.022 g ammonium tungstate in 15 mL of water. Thereafter, the thus-impregnated catalyst was dried, calcined for 1 hour in air at 1250° F., and heated in 15 oxidation/reduction cycles (as has been described for Catalyst B). Catalyst L contained about 4800 ppm Sb and about 1500 ppm W.

Catalysts I–L were evaluated in a MAT cracking test apparatus, as has been described in Example I. Pertinent test results (averages of two or three measurements) are summarized in Table III.

TABLE III

| Catalyst | Catalyst Additive | % Feed Conversion | % Gasoline Yield | % Light Cycle Oil Yield | % Heavy Cycle Oil Yield | % Coke Yield | $H_2$ Yield (SCF/BF)[1] | % $C_1$–$C_4$ Yield[2] |
|---|---|---|---|---|---|---|---|---|
| I | — | 76.8 | 50.1 | 14.9 | 8.3 | 11.8 | 265 | 14.9 |
| J | 4800 ppm Sb | 77.9 | 50.1 | 13.9 | 8.2 | 11.5 | 249 | 16.4 |
| K | 1500 ppm W | 76.8 | 49.0 | 15.0 | 8.2 | 11.7 | 370 | 16.1 |
| L | 4800 ppm Sb + 1500 ppm W | 78.9 | 51.5 | 13.8 | 7.4 | 11.4 | 264 | 15.9 |

[1]Standard cubic feet $H_2$ per barrel feed oil

[2]Yields of individual $C_1$–$C_4$ hydrocarbons were: 1.3–1.5% methane, 0.9–1.1% ethylene, 0.9–1.1% ethane, 4.0–4.4% propylene, 2.8–3.2% n-butenes, 3.2–4.0% isobutane, and 0.9–1.1% n-butane Note:

All % yields were calculated as follows: weight of individual product (per hours) divided by weight of converted feed (per hour) times 100.

Test results in Table III demonstrate that the cracking test employing Catalyst L (containing both Sb and W) had resulted in the highest feed conversion, the highest gasoline yield, the lowest heavy cycle oil yield and the lowest coke yield. The high gasoline yield attained with Catalyst L is surprising because passivation with W alone resulted in a lower gasoline yield (as per comparison of Catalyst K with base Catalyst I). In addition to the test data shown in Table III, it was observed that the ratio of desirable isobutane to other (less desirable) $C_4$ hydrocarbons was highest in the invention run with Catalyst L.

Reasonable variations and modifications which will be apparent to those skilled in the art, can be made within the scope of the disclosure and appended claims without departing from the scope of this invention.

That which is claimed is:

1. In a process for catalytically cracking a hydrocarbon-containing oil feed which contains metal impurities in the substantial absence of added hydrogen gas and in the presence of a zeolite-containing catalytic cracking catalyst in a catalytic cracking zone, wherein said zeolite-containing catalytic cracking catalyst has been contacted with at least one antimony compound at such conditions as to incorporate at least about 0.01 weight percent antimony into said cracking catalyst, the improvement which comprises additionally contacting said cracking catalyst with at least one zirconium compound as such conditions as to incorporate additionally at least 0.01 weight percent zirconium into said cracking catalyst, thereby causing a decrease of the amount of hydrogen gas generated in said process.

2. A process in accordance with claim 1, wherein said zeolite-containing catalyst cracking comprises at least one zeolite embedded in a silica-alumina matrix.

3. A process in accordance with claim 2, wherein said zeolite-containing catalytic cracking comprises nickel and vanadium impurities.

4. A process in accordance with claim 1, wherein about 0.01–5 weight-% Sb and about 0.01–5 weight-% Zr have been incorporated into said cracking catalyst.

5. A process in accordance with claim 4, wherein said at least one antimony compound is antimony tris(2-hydroxyethylthiolate) and said at least one zirconium compound with zirconium(IV) acetylacetonate.

6. A process in accordance with claim 1, wherein said hydrocarbon-containing oil feed has an API gravity, measured at 60° F., of about 5–40, and contains about 0.05–30 ppm nickel, about 0.1–50 ppm vanadium, about 0.1–5 weight-% sulfur, and about 0.1–20 weight-% Ramsbottom carbon residue.

7. A process in accordance with claim 1, wherein the conditions in said cracking zone comprise a temperature in the range of about 800° F. to about 1200° F. and a weight ratio of said cracking catalyst to said oil feed in the range of about 2:1 to about 10:1.

8. A process in accordance with claim 7, wherein said cracking zone is a fluidized-bed catalyst cracking reactor, and added steam is present in said fluidized-bed catalytic cracking reactor at a weight ratio of steam to said oil feed in the range of about 0.05:1 to about 0.5:1.

9. In a process for catalytically cracking a hydrocarbon-containing oil feed which contains metal impurities in the substantial absence of added hydrogen gas and in the presence of a zeolite-containing catalytic cracking catalyst in a catalytic cracking zone, wherein at least one antimony compound has been added to said oil feed at such conditions as to incorporate at least about 0.01 weight percent antimony into said cracking catalyst in said cracking zone, the improvement which comprises additionally adding at least one zirconium compound to said oil feed at such conditions as to incorporate additionally at least about 0.01 weight percent zirconium into said cracking catalyst in said cracking zone, thereby causing a decrease of the amount of hydrogen gas generated in said process.

10. A process in accordance with claim 9, wherein said zeolite-containing catalytic cracking catalyst comprises at least one zeolite embedded in a silica-alumina matrix.

11. A process in accordance with claim 10, wherein said zeolite-containing catalytic cracking catalytic contains compounds of nickel and vanadium as impurities.

12. A process in accordance with claim 9, wherein said at least one antimony compound and said at least one zirconium compound have been added to said oil feed in such amounts as to incorporate about 0.01–5 weight-% Sb and about 0.01–5 weight-% Zr into said cracking catalyst.

13. A process in accordance with claim 12, wherein said at least one antimony compound is tris(2-hydroxyethylthiolate) and said at least one zirconium compound is zirconium(IV) acetylacetonate.

14. A process in accordance with claim 12, wherein the concentration of added antimony in said oil feed is about 0.1–5,000 ppm Sb, and the concentration of added zirconium in said oil feed is about 0.1–5,000 ppm Zr.

15. A process in accordance with claim 9, wherein said hydrocarbon-containing oil feed has an API gravity, measured at 60° F., of about 5–40, and contains about 0.05–30 ppm nickel, about 0.1–50 ppm vanadium, about 0.1–5 weight-% sulfur, and about 0.1–20 weight-% Ramsbottom carbon residue.

16. A process in accordance with claim 9, wherein the conditions in said cracking zone comprise a temperature in the range of about 800° F. to about 1200° F. and a weight ratio of said cracking catalyst to said oil feed in the range of about 2:1 to about 10:1.

17. A process in accordance with claim 16, wherein said cracking zone is a fluidized-bed catalytic cracking reactor, and added steam is present in said fluidized-bed catalytic cracking reactor at a weight ratio of steam to said oil feed in the range of about 0.05:1 to about 0.5:1.

18. A process for catalytically cracking a hydrocarbon-containing oil feed which contains metal impurities in the substantial absence of added hydrogen gas and in the presence of a zeolite-containing catalytic cracking catalyst in a catalytic cracking zone, wherein said zeolite-containing catalytic cracking catalyst has been contacted with at least one antimony compound at such conditions as to incorporate at least about 0.01 weight percent antimony into said cracking catalyst, the improvement which comprises additionally contacting said cracking catalyst with at least one tungsten compound at such conditions as to incorporate additionally at least about 0.01 weight percent tungsten into said cracking catalyst, thereby causing an increase of the amount of gasoline produced in said process.

19. A process in accordance with claim 18, wherein said zeolite-containing catalytic cracking catalyst comprises at least one zeolite embedded in a silica-alumina matrix.

20. A process in accordance with claim 19, wherein said zeolite-containing catalytic cracking catalyst comprises nickel and vanadium impurities.

21. A process in accordance with claim 18, wherein about 0.01–5 weight-% Sb and about 0.01–5 weight-% W have been incorporated into said cracking catalyst.

22. A process in accordance with claim 21, wherein said at least one antimony compound is antimony tris(2-hydroxyethylthiolate) and said at least one tungsten compound is ammonium tungstate.

23. A process in accordance with claim 18, wherein said hydrocarbon-containing oil feed has an API gravity, measured at 60° F., of about 5–40, and contains about 0.05–30 ppm nickel, about 0.1–50 ppm vanadium, about 0.1–5 weight-% sulfur, and about 0.1–20 weight-% Ramsbottom carbon residue.

24. A process in accordance with claim 18, wherein the conditions in said cracking zone comprise a temperature in the range of about 800° F. to about 1200° F. and a weight ratio of said cracking catalyst to said oil feed in the range of about 2:1 to about 10:1.

25. A process in accordance with claim 24, wherein said cracking zone is a fluidized-bed catalytic cracking reactor, and added steam is present in said fluidized-bed catalytic cracking reactor at a weight ratio of steam to said oil feed in the range of about 0.05:1 to about 0.5:1.

26. In a process for catalytically cracking a hydrocarbon-containing oil fed in the substantial absence of added hydrogen gas and in the presence of a zeolite-containing catalytic cracking catalyst in a catalytic cracking zone, wherein at least one antimony compound has been added to said oil feed at such conditions as to incorporate at least about 0.01 weight percent antimony into said cracking catalyst in said cracking zone, the improvement which comprises additionally adding at least one tungsten compound to said oil feed at such conditions at to incorporate additionally at least about 0.01 weight percent tungsten into said cracking catalyst in said cracking zone, thereby causing an increase of the amount of gasoline produced in said process.

27. A process in accordance with claim 26, wherein said zeolite-containing catalytic cracking catalyst comprises at least one zeolite embedded in a silica-alumina matrix.

28. A process in accordance with claim 27, wherein said zeolite-containing catalytic cracking catalyst contains compounds of nickel and vanadium as impurities.

29. A process in accordance with claim 26, wherein said at least one antimony compound and said at least one tungsten compound have been added to said oil feed in such amounts as to incorporate about 0.01–5 weight-% Sb and a level of about 0.01–5 weight-% W into said cracking catalyst.

30. A process in accordance with claim 29, wherein said at least one antimony compound is antimony tris(2-hydroxyethylthiolate) and said at least one tungsten compound is ammonium tungstate.

31. A process in accordance with claim 26 wherein the concentration of added antimony in said oil feed is about 0.1–5,000 ppm Sb, and the concentration of added tungsten in said oil feed is about 0.1–5,000 ppm W.

32. A process in accordance with claim 26, wherein said hydrocarbon-containing oil feed has an API gravity, measured at 60° F., of about 5–40, and contains about 0.05–30 ppm nickel, about 0.1–50 ppm vanadium, about 0.1–5 weight-% sulfur, and about 0.1–20 weight-% Ramsbottom carbon residue.

33. A process in accordance with claim 26, wherein the conditions in said cracking zone comprises a temperature in the range of about 800° F. to about 1200° F. and a weight ratio of said cracking catalyst to said oil feed in the range of about 2:1 to about 10:1.

34. A process in accordance with claim 33, wherein said cracking zone is a fluidized-bed catalytic cracking reactor, and added steam is present in said fluidized-bed catalytic cracking reactor at a weight ratio of steam to said oil feed in the range of about 0.05:1 to about 0.5:1.

* * * * *

UNITED STATES PATENT AND TRADEMARK OFFICE
CERTIFICATE OF CORRECTION

PATENT NO. : 5,378,349

DATED : January 3, 1995

INVENTOR(S) : Dwayne R. Senn

It is certified that error appears in the above-identified patent and that said Letters Patent is hereby corrected as shown below:

Claim 3, column 12, line 21, insert --- catalyst --- between "cracking" and "comprises".

Claim 8, column 12, line 56, delete "catalyst" before "cracking" and insert --- catalytic --- therefor.

Claim 11, column 13, line 13, delete "catalytic" after "cracking" and insert --- catalyst --- therefor.

Claim 13, column 13, line 22, insert --- antimony --- after "is".

Claim 18, column 13, line 46, delete "A" before "process" and insert --- In a --- therefor.

Signed and Sealed this

Seventh Day of March, 1995

*Attest:*

Bruce Lehman

BRUCE LEHMAN

*Attesting Officer*

*Commissioner of Patents and Trademarks*